US008471797B2

(12) United States Patent
Kim et al.

(10) Patent No.: US 8,471,797 B2
(45) Date of Patent: Jun. 25, 2013

(54) LIQUID CRYSTAL DISPLAY AND METHOD OF DRIVING THE SAME

(75) Inventors: Ho-Young Kim, Cheonan-si (KR); Hyung-Ku Kang, Seoul (KR); Woo-Young Lee, Daegu (KR)

(73) Assignee: Samsung Display Co., Ltd. (KR)

( * ) Notice: Subject to any disclaimer, the term of this patent is extended or adjusted under 35 U.S.C. 154(b) by 730 days.

(21) Appl. No.: 12/617,037

(22) Filed: Nov. 12, 2009

(65) Prior Publication Data

US 2010/0118063 A1 May 13, 2010

(30) Foreign Application Priority Data

Nov. 12, 2008 (KR) ..... 10-2008-0112388

(51) Int. Cl.
*G09G 3/36* (2006.01)

(52) U.S. Cl.
USPC ..... 345/89; 345/87

(58) Field of Classification Search
None
See application file for complete search history.

(56) References Cited

U.S. PATENT DOCUMENTS

| | | | | |
|---|---|---|---|---|
| 7,268,759 | B2 * | 9/2007 | Hsu | 345/89 |
| 2008/0272701 | A1 * | 11/2008 | Park et al. | 315/151 |
| 2009/0102864 | A1 * | 4/2009 | Fan-Chiang et al. | 345/690 |

FOREIGN PATENT DOCUMENTS

| | | |
|---|---|---|
| JP | 2006025263 | 1/2006 |
| KR | 1020050104889 | 11/2005 |
| KR | 1020060000699 | 1/2006 |

* cited by examiner

*Primary Examiner* — Joseph Haley
(74) *Attorney, Agent, or Firm* — Cantor Colburn LLP

(57) ABSTRACT

A liquid crystal display includes: a display panel, which displays an image corresponding to a primary image signal, which includes a first image signal, a second image signal and a third image signal; a light-emitting unit, which supplies light to the display panel; and a timing controller, which receives an input including the primary image signal, and outputs a converted image signal. The timing controller converts each of the first image signal, the second image signal and the third image signal on a basis of whichever one of the first image signal, the second image signal and the third image signal is selected, and outputs the converted image signal. The light-emitting unit determines a luminance of the light supplied to the display panel according to a reference grayscale of a reference image signal, the reference image signal being selected among the first image signal, the second image signal and the third image signal.

19 Claims, 10 Drawing Sheets

LIQUID CRYSTAL DISPLAY AND METHOD OF DRIVING THE SAME

This application claims priority to Korean Patent Application No. 10-2008-0112388, filed on Nov. 12, 2008, and all the benefits accruing therefrom under 35 U.S.C. §119, the contents of which in its entirety are herein incorporated by reference.

BACKGROUND OF THE INVENTION

1. Field of the Invention

This disclosure relates to a liquid crystal display and a method driving the same, and more particularly, to a liquid crystal display and a method of driving the same in which display quality of the liquid crystal display can be enhanced while reducing power consumption.

2. Description of the Related Art

A liquid crystal display ("LCD") includes a display panel which includes a first display substrate having pixel electrodes, a second display substrate having common electrodes, and a liquid crystal layer having anisotropic dielectric properties and which is interposed between the first and second display substrates. Electric fields are formed between the pixel electrodes and the common electrodes, and the amount of light transmitted through the display panel is controlled by selecting intensities of the electric fields to thereby display a desired image. Since the LCD is not self-emissive, the LCD includes a plurality of light-emitting blocks for providing light to the display panel.

It is desirable for a luminance of the light-emitting blocks to be controlled individually in accordance with the image being displayed on the display panel in an effort to improve display quality.

BRIEF SUMMARY OF THE INVENTION

Aspects of exemplary embodiments of the invention provide a liquid crystal display, in which display quality can be enhanced while reducing power consumption.

Aspects of exemplary embodiments of the invention also provide a method of driving a liquid crystal display, in which display quality of the liquid crystal display can be enhanced while reducing power consumption.

However, the aspects of exemplary embodiments of the invention are not restricted to those set forth herein. The above and other aspects, features and advantages of exemplary embodiments of the invention will become more apparent to one of ordinary skill in the art to which the invention pertains by referencing the further detailed description of exemplary embodiments of the invention given below.

According to an aspect of an exemplary embodiment of the invention, disclosed is a liquid crystal display including: a display panel, which displays an image corresponding to a primary image signal, which includes a first image signal, a second image signal and a third image signal; a light-emitting unit, which supplies light to the display panel; and a timing controller, which receives an input including the primary image signal, and outputs a converted image signal. The timing controller converts each of the first image signal, the second image signal and the third image signal on a basis of whichever one of the first image signal, the second image signal and the third image signal is selected, and outputs the converted image signal. The light-emitting unit determines a luminance of the light supplied to the display panel according to a reference grayscale of a reference image signal, the reference image signal being selected among the first image signal, the second image signal and the third image signal.

According to another aspect of an exemplary embodiment of the invention, disclosed is a method of driving a liquid crystal display, the method including: providing a display panel, which displays an image corresponding to a primary image signal, which includes a first image signal, a second image signal and a third image signal; receiving the primary image signal; converting each of the first image signal, the second image signal and the third image signal on a basis of whichever one of the first image signal, the second image signal and the third image signal is selected, and outputting the converted image signal; and determining a luminance of the light supplied to the display panel according to a reference grayscale of a reference image signal, the reference image signal being selected among the first image signal, the second image signal and the third image signal.

BRIEF DESCRIPTION OF THE DRAWINGS

The above and other aspects and features of the invention will become more apparent by describing in detail exemplary embodiments thereof with reference to the attached drawings, in which.

DETAILED DESCRIPTION OF THE INVENTION

The invention is described more fully hereinafter with reference to the accompanying drawings, in which exemplary embodiments of the present invention are illustrated. The invention may, however, be embodied in different forms and should not be construed as limited to the embodiments set forth herein. Rather, these embodiments are provided so that this disclosure will be thorough and complete, and will fully convey the scope of the present invention to those skilled in the art.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers denote like elements throughout the specification. As used herein the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components and/or groups thereof Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A liquid crystal display ("LCD") and a method of driving the same are hereinafter described in further detail with reference to FIGS. 1 to 10.

Figure 1:
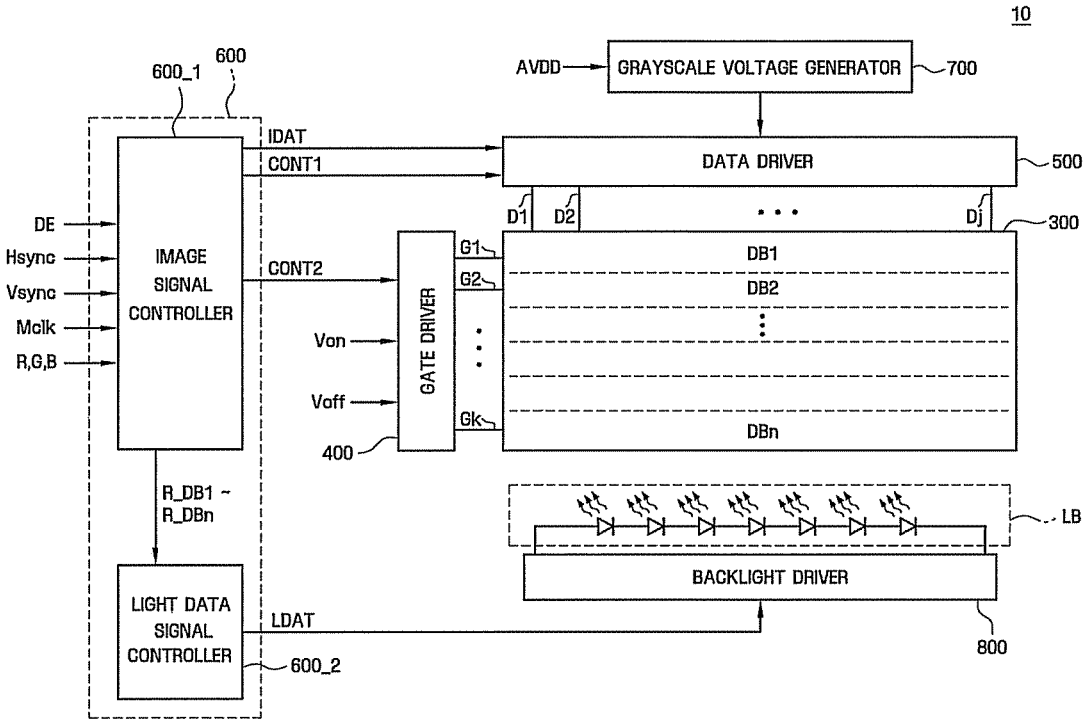
FIG. 1 is a block diagram showing an exemplary embodiment of a liquid crystal display and a method of driving the same.
Figure 2:
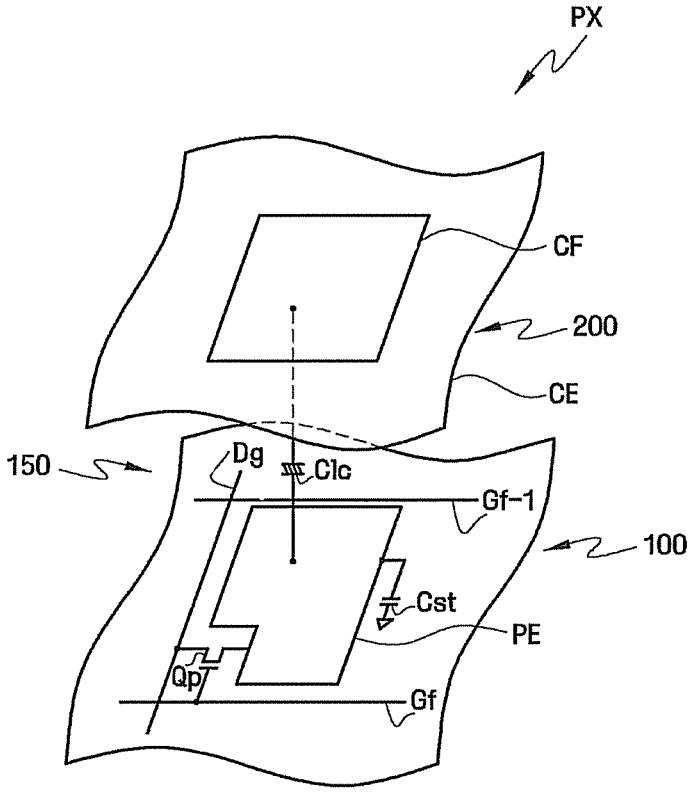
FIG. 2 is an equivalent circuit diagram showing an exemplary embodiment of a pixel included in a display panel of FIG. 1.
Figure 3:
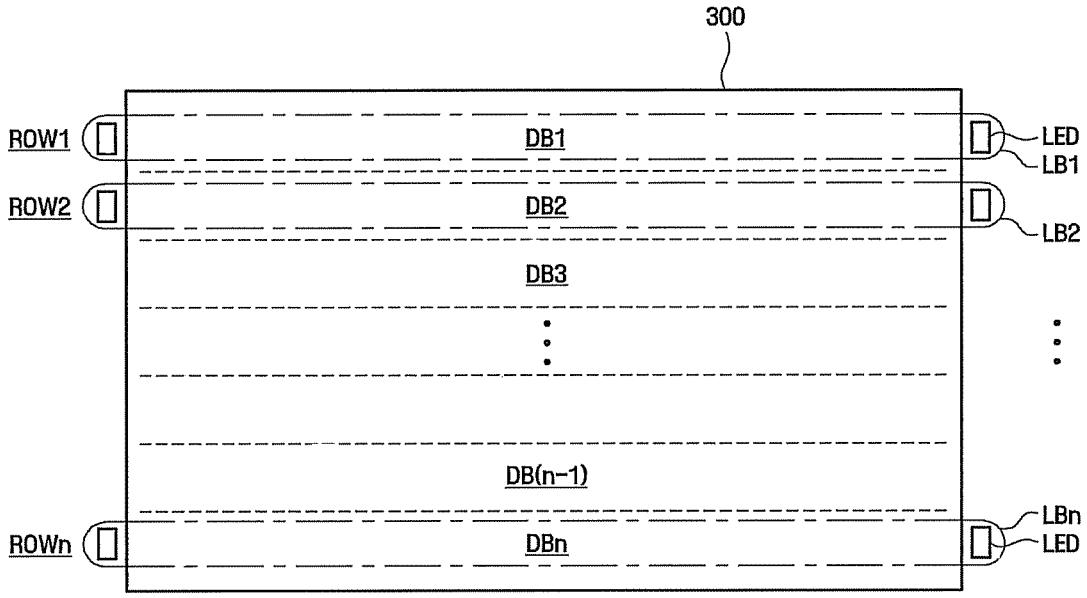
FIG. 3 is a schematic diagram illustrating an exemplary embodiment of an arrangement of display blocks and light-emitting blocks of FIG. 1.
Figure 4:
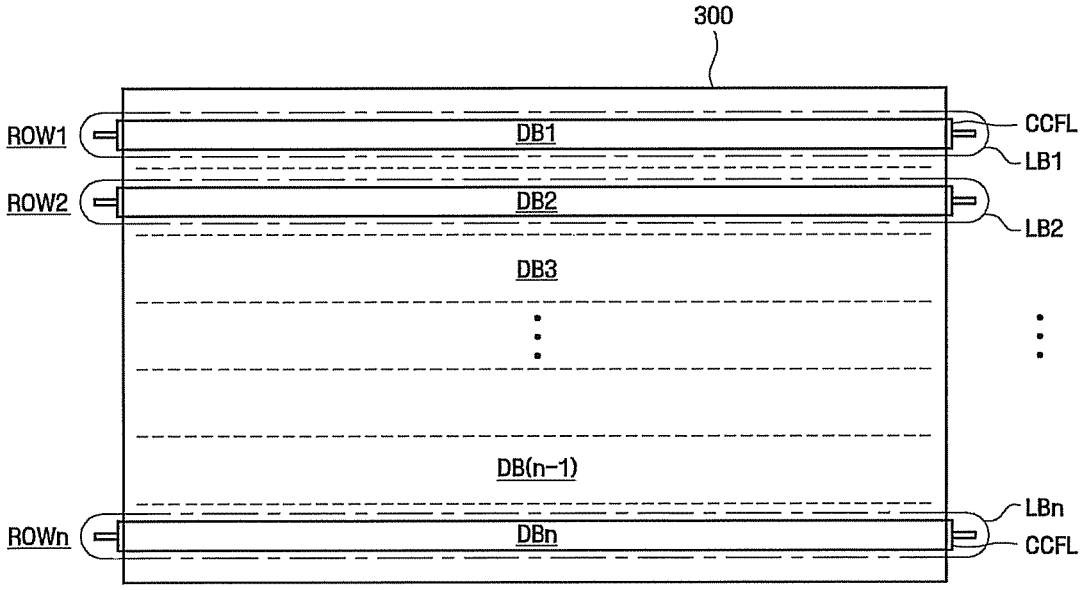
FIG. 4 is a schematic diagram illustrating another exemplary embodiment of an arrangement of display blocks and light-emitting blocks of FIG. 1.
Figure 5:
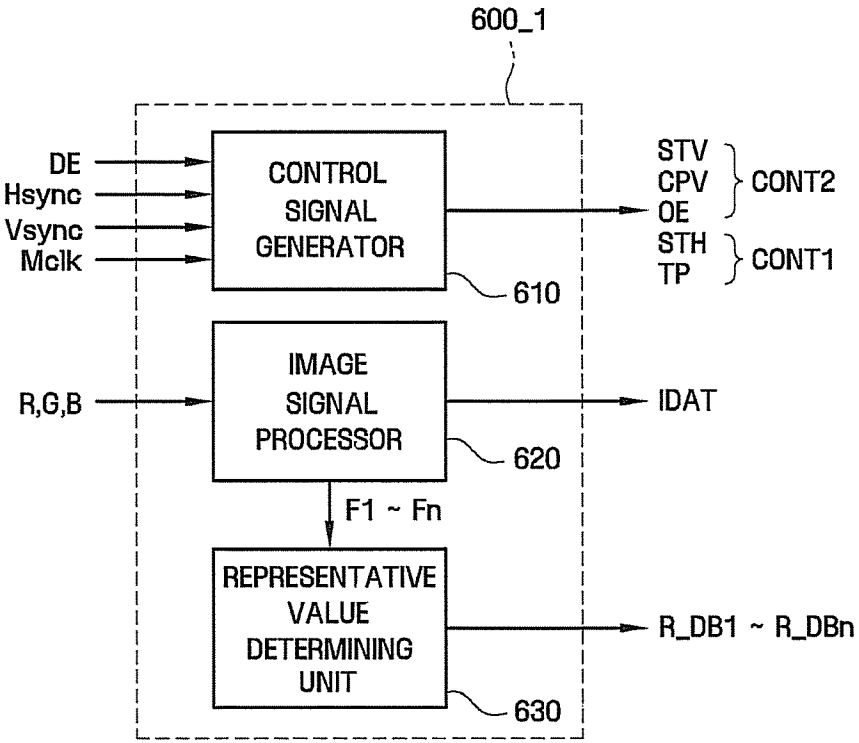
FIG. 5 is a block diagram showing an exemplary embodiment of an image signal controller of FIG. 1.
Figure 6:
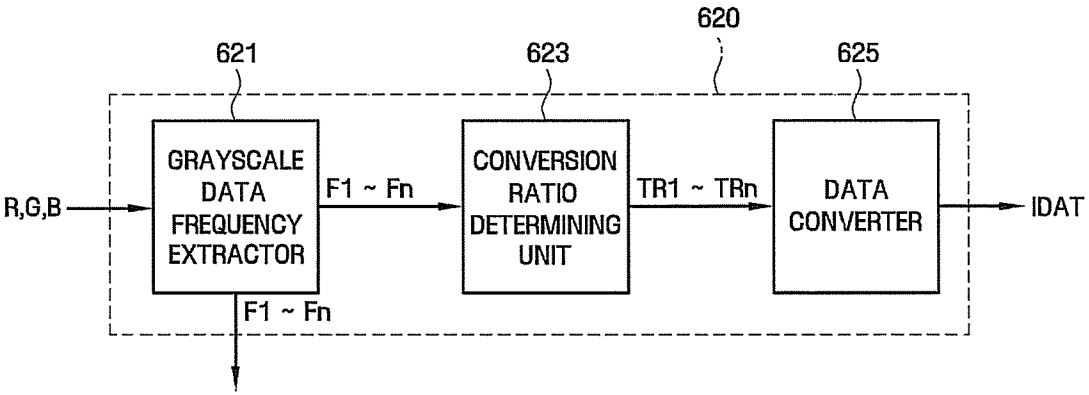
FIG. 6 is a block diagram showing an exemplary embodiment of an image signal processor of FIG. 5.
Figure 7A:
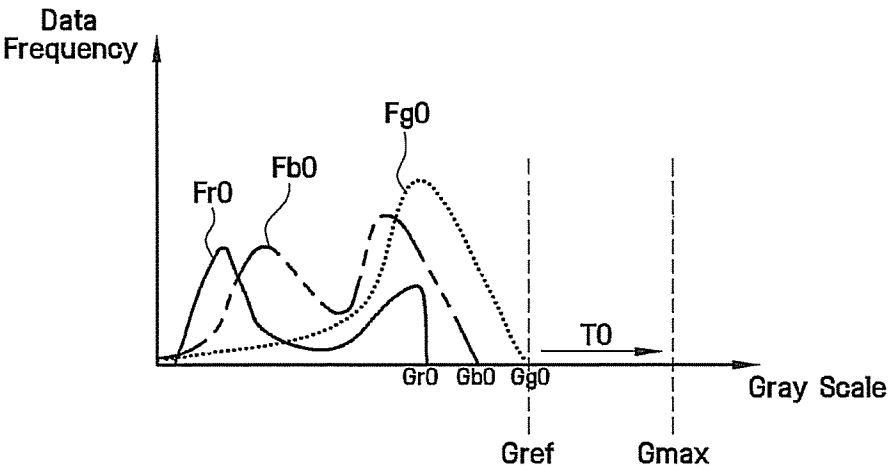
FIGS. 7*a* and 7*b* are graphs showing data frequency with respect to gray scale in an exemplary embodiment of a method of extracting a grayscale data frequency, and converting each image signal.
Figure 7B:
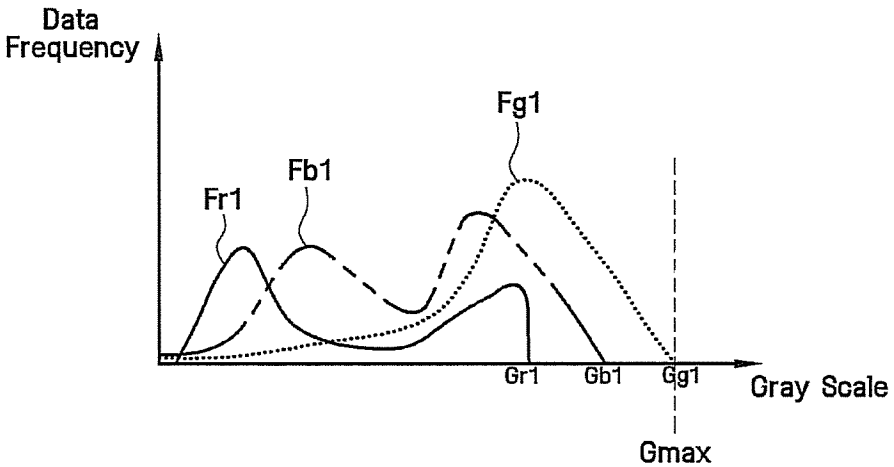
Figure 8:
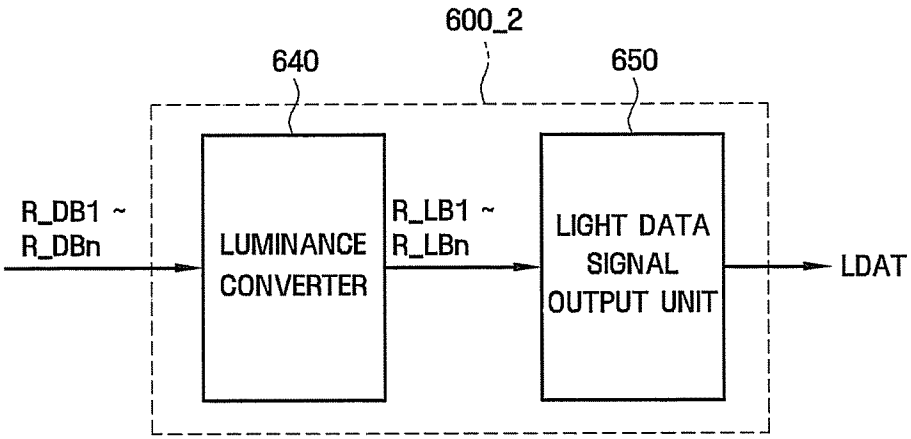
FIG. 8 is a block diagram showing an exemplary embodiment of a light data signal unit of FIG. 1.
Figure 9:
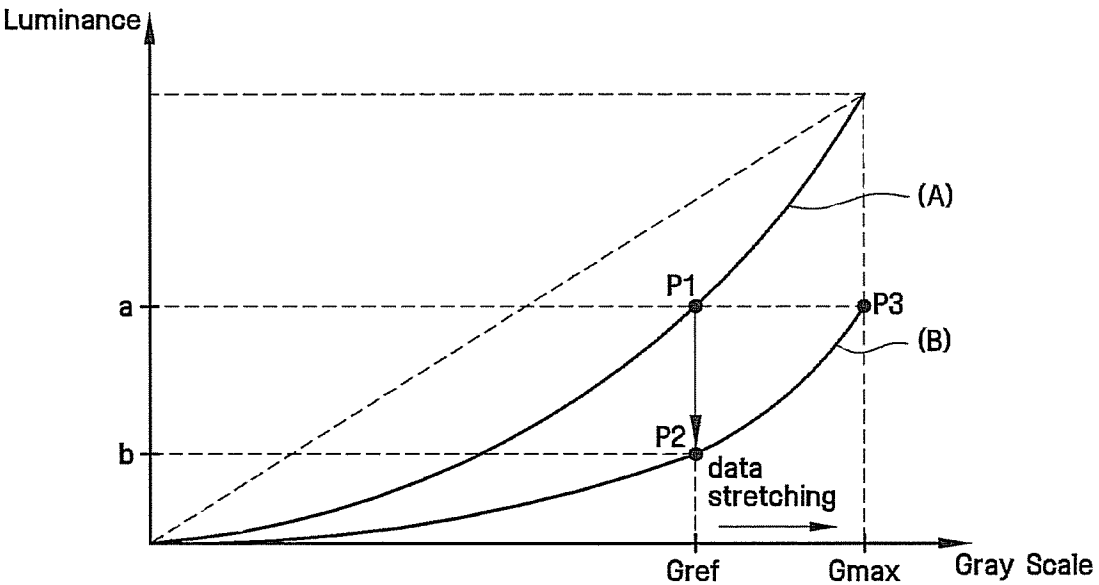
FIG. 9 is a graph showing luminance change with respect to grayscale, and showing an exemplary embodiment of a method of determining a duty ratio of a light data signal.
Figure 10:
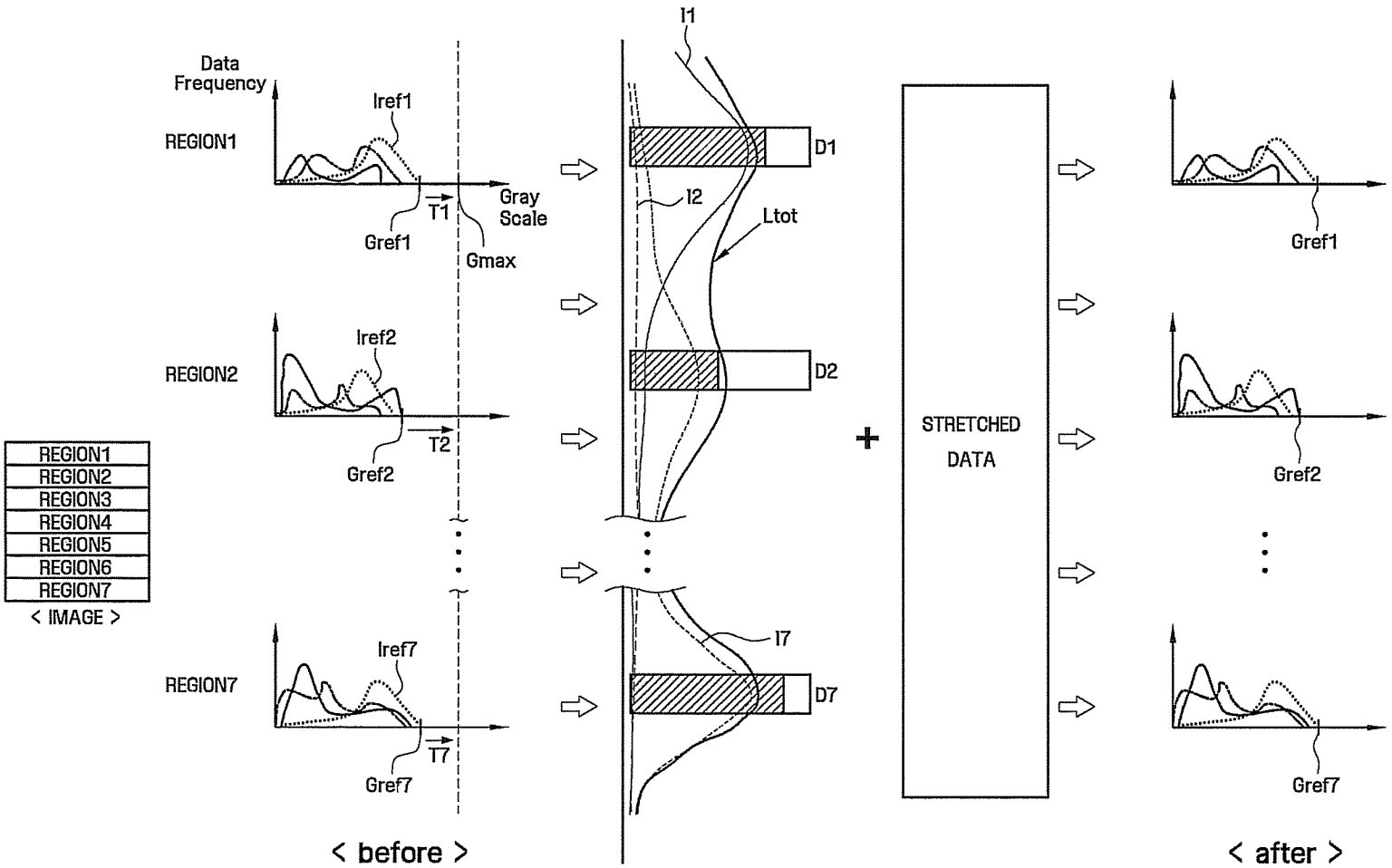
FIG. 10 is a schematic diagram showing states prior to and subsequent to conversion of each image signal.

FIG. 1 is a block diagram showing an exemplary embodiment of a liquid crystal display and a method of driving the same. FIG. 2 is an equivalent circuit diagram showing an exemplary embodiment of a pixel included in a display panel of FIG. 1. FIG. 3 is a schematic diagram illustrating an exemplary embodiment of an arrangement of display blocks and light-emitting blocks of FIG. 1. FIG. 4 is a schematic diagram illustrating another exemplary embodiment of an arrangement of display blocks and light-emitting blocks of FIG. 1. FIG. 5 is a block diagram showing an exemplary embodiment of an image signal controller of FIG. 1. FIG. 6 is a block diagram showing an exemplary embodiment of an image signal processor of FIG. 5. FIGS. 7*a* and 7*b* are graphs showing data frequency with respect to gray scale in an exemplary embodiment of a method of extracting a grayscale data frequency, and converting each image signal. FIG. 8 is a block diagram showing an exemplary embodiment of a light data signal unit of FIG. 1. FIG. 9 is a graph showing luminance changes with respect to grayscale, and showing an exemplary embodiment of a method of determining a duty ratio of a light data signal. FIG. 10 is a schematic diagram showing states prior to and subsequent to conversion of each image signal.

Referring to FIG. 1, a liquid crystal display 10 according to an embodiment includes a display panel 300, a timing controller 600, a gate driver 400, a data driver 500, a grayscale voltage generator 700 and a light-emitting unit. The light-emitting unit includes a backlight driver 800 and a light-emitting block LB electrically connected to the backlight driver 800.

The display panel 300 includes a plurality of display blocks DB1 to DBn. In an embodiment, the plurality of display blocks DB1 to DBn may be arranged in rows. Each of the display blocks DB1 to DBn may include a plurality of pixels. In an embodiment, the plurality of pixels may be arranged in a matrix configuration including a k-number of columns and a j-number of rows, and the plurality of pixels arranged in the matrix configuration may be divided into a plurality of units of rows to define the plurality of display blocks DB1 to DBn.

Although not shown in the drawings, the plurality of pixels may be divided into red sub-pixels, green sub-pixels and blue sub-pixels. In addition, the display panel 300 may include a plurality of gate lines G1 to Gk and a plurality of data lines D1 to Dj. Each pixel may be defined by a region of intersection of one of the gate lines and one of the data lines.

In an embodiment, the display panel 300 displays an image corresponding to primary image signals R, G and B, including a first image signal, a second image signal and a third image signal. The first, second and third image signals maybe, for example, a red image signal, a green image signal and a blue image signal, respectively. The following disclosure describes an embodiment wherein the first image signal is a red image signal, the second image signal is a green image signal and the third image signal is a blue image signal. However, this is merely one example of the image signals, and such designations may be changed in a variety of ways. The process of displaying images corresponding to the primary image signals R, G and B on the display panel 300 is hereinafter further described in greater detail.

FIG. 2 is an equivalent circuit diagram showing an exemplary embodiment of a pixel. In an embodiment, the pixel PX is connected to an $f^{th}$ gate line Gf, wherein f is from about 1 to about k, and to a $g^{th}$ data line Dg, wherein g is from about 1 to about j, and the pixel includes a switching element Qp electrically connected to the gate line Gf and the data line Dg and a liquid crystal capacitor Clc and a storage capacitor Cst electrically connected to the switching element Qp. As shown in FIG. 2, the liquid crystal capacitor Clc may comprise two electrodes, for example, a pixel electrode PE of a first display substrate 100 and a common electrode CE of a second display substrate 200, and liquid crystal molecules 150 interposed between the pixel electrode PE and the common electrode CE. A color filter CF is disposed on a portion of the common electrode CE.

Referring to FIG. 1, the timing controller 600 receives input of the primary image signals R, G and B, which in an embodiment include a red image signal, a green image signal and a blue image signal, and external control signals, the external control signals including a vertical synchronization signal Vsync, a horizontal synchronization signal Hsync, a main clock signal Mclk, and a data enable signal DE for controlling display of the primary image signals R, G and B, and outputs a converted image signal IDAT, a data control signal CONT1, a gate control signal CONT2, and a light data signal LDAT. In an embodiment, the timing controller 600 may receive the primary image signals R, G and B and output a converted image signal IDAT corresponding to the same, and may provide a light data signal LDAT corresponding to an image displayed by each display block DB1 to DBn.

The timing controller 600 may be functionally divided into an image signal controller 600_1 and a light data signal controller 600_2. The image signal controller 600_1 may control the images displayed on the display panel 300, and the light data signal controller 600_2 may control the backlight driver 800. In an embodiment, the image signal controller 600_1 and the light data signal controller 600_2 may be physically separated.

In further detail, the image signal controller 600_1 receives the primary image signals R, G and B and outputs the converted image signal IDAT corresponding thereto. The image signal controller 600_1 may convert each of the red image signal, the green image signal and the blue image signal on the basis of whichever one of the red image signal, the green image signal and the blue image signal has the largest grayscale value to thereby output the converted image signal IDAT. This is further described in greater detail below.

The image signal controller 600_1 receives the external control signals Vsync, Hsync, Mclk and DE and generate the data control signal CONT1 and the gate control signal CONT2. Exemplary external control signals include a vertical synchronization signal Vsync, a horizontal synchronization signal Hsync, a main clock signal Mclk, and a data enable signal DE. The data control signal CONT1 is a signal for controlling the operation of the data driver 500, the gate control signal CONT2 is a signal for controlling the operation of the gate driver 400. In addition, the image signal controller 600_1 may receive the primary image signals R, G and B and output representative image signals R_DB1 to R_DBn corresponding to each of the display blocks DB1 to DBn to the light data signal controller 600_2. The operation and internal structure of the image signal controller 600_1 is further described hereinafter with reference to FIG. 5.

The light data signal controller 600_2 may receive the representative image signals R_DB1 to R_DBn, generate a light data signal LDAT from each of the representative image signals R_DB1 to R_DBn, and supply the light data signal LDAT to the backlight driver 800. The light data signal LDAT may control a luminance of light supplied by a light-emitting unit. The light data signal LDAT controls the luminance of light supplied by the light-emitting unit according to a reference grayscale of whichever one of the red image signal, the green image signal and the blue image signal of the primary image signal is determined to be a reference image signal. The operation and internal structure of the light data signal controller 600_2 is further described hereinafter with reference to FIG. 6.

The gate driver 400 receives the gate control signal CONT2 from the image signal controller 600_1 and applies a gate signal to the gate lines G1 to Gk. The gate signal is a combination of a gate on voltage Von and a gate off voltage Voff supplied from a gate on/off voltage generator (not shown). The gate control signal CONT2 is a signal for controlling the operation of the gate driver 400, and may include a vertical start signal STV which initiates operation of the gate driver 400, a gate clock signal CPV which determines an output timing of a gate on voltage Von, and an output enable signal OE which determines a pulse width of the gate on voltage Von.

The data driver 500 receives the data control signal CONT1 from the image signal controller 600_1 and applies an image data voltage to the data lines D1 to Dj. The image data voltage may be a voltage supplied from the grayscale voltage generator 700. In an embodiment, the image data voltage may be a voltage in which a drive voltage AVDD is divided according to a grayscale of the converted image signal IDAT. The data control signal CONT1 includes a signal controlling the operation of the data driver 500. The signal controlling the operation of the data driver 500 may include a horizontal start signal STH for initiating operation of the data driver 500 and an output instruction signal TP for instructing output of the image data voltage.

The light-emitting block LB may include a plurality of light-emitting blocks LB1 to LBn corresponding to the display blocks DB1 to DBn. The light-emitting blocks LB1 to LBn are disposed under the display panel 300 to thereby supply light to the display panel 300. The light-emitting blocks LB1 to LBn may be arranged as shown in FIGS. 3 and 4. Each of the light-emitting blocks LB1 to LBn may be arranged to correspond to each row ROW1 to ROWn of the display blocks DB1 to DBn. The light-emitting blocks LB1 to LBn may supply light in a manner corresponding respectively to the display blocks DB1 DBn.

As shown in FIG. 3, a light source included in each of the light-emitting blocks LB1 to LBn may be disposed in an edge-type configuration. The light source of each of the light-emitting blocks LB1 to LBn may be a point light source disposed to either side and under the display panel 300, and may be, in an embodiment, a light-emitting diode ("LED"). In another embodiment, with reference to FIG. 4, a light source included in each of the light-emitting blocks LB1 to LBn may be disposed in a direct-type configuration. As shown in FIG. 4, the light source of each of the light-emitting blocks LB1 to LBn may be a line light source disposed under the display panel 300 and uniformly aligned with one of the display blocks DB1 to DBn. For example, in the exemplary embodiment shown in FIG. 4, the light source of each of the light-emitting blocks LB1 to LBn may be a cold cathode fluorescent lamp ("CCFL") or a hot cathode fluorescent lamp ("HCFL").

Referring again to FIG. 1, the backlight driver 800 controls a luminance of light supplied by each of the light-emitting blocks LB1 to LBn in response to the light data signal LDAT. The light data signal LDAT has a first duty ratio, which may be less than a second duty ratio corresponding to the reference grayscale of the reference image signal.

The image signal controller 600_1 and the light data signal controller 600_2, as shown in FIG. 1, are hereinafter further described in greater detail with reference to FIGS. 5 to 7*b*.

The image signal controller 600_1 of FIG. 1 is first described with reference to FIG. 5. The image signal controller 600_1 may include a control signal generator 610, an image signal processor 620 and a representative value determining unit 630.

The control signal generator 610 receives the external control signals Vsync, Hsync, Mclk and DE, and outputs the data control signal CONT1 and the gate control signal CONT2. In an embodiment, the control signal generator 610 may output the vertical start signal STV, which initiates operation of the gate driver 400 of FIG. 1, the gate clock signal CPV, which determines the output timing of the gate on voltage Von, the output enable signal OE, which determines the pulse width of the gate on voltage Von, the horizontal start signal STH, which initiates operation of the data driver 500, and the output instruction signal TP, which instructs output of the image data voltage.

The image signal processor 620 may receive the primary image signals R, G and B and output the converted image signal IDAT. In greater detail, the image signal processor 620 may receive the primary image signals R, G and B, extract a data frequency F, wherein F can be F1 to Fn, for each grayscale of each of the red image signal, the green image signal and the blue image signal, and convert each of the red image signal, the green image signal and the blue image signal using a reference image signal determined on the basis of whichever one of the red image signal, the green image signal and the blue image signal has the largest grayscale value, and output the converted image signal IDAT. The grayscale data frequency F for each of the red image signal, the green image signal and the blue image signal may be output to the representative value determining unit 630.

The image signal processor 620 is described in greater detail with reference to FIG. 6. The image signal processor 620 may include a grayscale data frequency extractor 621, a conversion ratio determining unit 623 and a data converter 625.

The grayscale data frequency extractor 621 may extract a data frequency, which is included in the red image signal, the green image signal and the blue image signal, with respect to each grayscale. In an embodiment, the grayscale data frequency extractor 621 may extract each grayscale data frequency of the red image signal, each grayscale data frequency of the green image signal and each grayscale data frequency of the blue image signal. The largest grayscales exhibited by the data in the image signals, i.e., in the red image signal, the green image signal and the blue image signal, may be designated respectively as first, second, and third grayscales.

Referring to FIG. 7*a*, shown are exemplary of grayscale data frequencies Fr0, Fg0 and Fb0 respectively for the red image signal, the green image signal and the blue image signal extracted from the primary image signals R, G and B by the grayscale data frequency extractor 621. In the graph of FIG. 7*a*, the abscissa corresponds to grayscale and the ordinate corresponds to data frequency of the corresponding grayscale. In FIG. 7*a*, while the grayscale data frequency for each image signal is shown as a curve with respect to gray scale, the present embodiment is not limited in this regard, and the grayscale data frequencies may be obtained using a variety of methods.

From the grayscale data frequency Fr0, Fg0 and Fb0 of each image signal, the grayscale data frequency extractor 621 may select the image signal with the largest grayscale to be a reference image signal. In an embodiment, the largest grayscale of each of the red image signal, the green image signal and the blue image signal may be respectively designated as a first grayscale, a second grayscale and a third grayscale. The largest grayscale among the first, second and third grayscales is designated as the reference grayscale, and an image signal, which includes the reference grayscale, may be selected to be the reference image signal. Thus the image signal can be selected from the red, green and blue image signals.

In an embodiment, as shown in FIG. 7*a*, the grayscale data frequency extractor 621 may extract the grayscale data frequency Fr0 of the red image signal, the grayscale data frequency Fg0 of the green image signal and the grayscale image frequency Fb0 of the blue image signal. Further, examining the grayscale image frequency Fr0 of the red image signal, the grayscale Gr0, which is the largest grayscale of the data in the red image signal, may be designated as the first grayscale. In the same manner, Ggo may be designated as the second grayscale and Gb0 may be designated as the third grayscale for the green image signal and the blue image signal, respectively. In an embodiment, the reference grayscale may be selected to be the second grayscale Gg0, as this is the largest of the first, second and third grayscales Gr0, Gg0 and Gb0. The image signal that includes the reference grayscale may be designated as the reference image signal.

In an embodiment, wherein a display block includes a plurality of the display blocks DB1 to DBn and a light-emitting unit includes a plurality of the light-emitting blocks LB1 to LBn corresponding respectively to the display blocks DB1 to DBn, the grayscale data frequency extractor 621 may extract grayscale data frequencies F1 to Fn of each image signal for each of the light-emitting blocks LB1 to LBn, and supply the grayscale data frequencies F1 to Fn to the representative value determining unit 630 and the conversion ratio determining unit 623. In another embodiment, a liquid crystal display includes a plurality of the display blocks DB1 to DBn and a plurality of the light-emitting blocks LB1 to LBn corresponding to the display blocks DB1 to DBn. In another embodiment, the plurality of the display blocks DB1 to DBn are omitted in the display panel 300.

Referring to FIGS. 6 and 7*a*, the conversion ratio determining unit 623 determines a conversion ratio for converting each image signal from the grayscale data frequency Fr0, Fg0 and Fb0 of each image signal obtained from the grayscale data frequency extractor 621. For example, in an embodiment wherein the largest grayscale, which can be displayed for each image signal is a maximum grayscale Gmax, the conversion ratio determining unit 623 may determine a ratio of a reference grayscale Gref with respect to a maximum grayscale Gmax of the grayscale data frequency F1 to Fn of each image signal to be a conversion ratio TR. In an embodiment, the conversion ratio determining unit 623 may determine a conversion ratio TR1 to TRn for each light-emitting block LB1 to LBn from the grayscale data frequency F1 to Fn with respect to each image signal of each light-emitting block LB1 to LBn. The maximum grayscale Gmax may refer to the largest grayscale among the grayscales, which can be displayed as images corresponding to each image signal. For example, if each signal for displaying an image exhibits 256 grayscales from 0 to 255, the maximum grayscale Gmax is 256 grayscales.

As shown in FIG. 7*a*, the green image signal may be selected as the reference image signal since the reference grayscale is the second grayscale Fg0 of the green image signal, and the ratio of the second grayscale Fg0 (i.e., the reference grayscale Gref) to the maximum grayscale Gref/Gmax may be selected to be the conversion ratio. The conversion ratio TR1 to TRn of each image signal for each light-emitting block LB1 to LBn may be similarly obtained. Accordingly, each conversion ratio TR1 to Trn of the plurality of the light-emitting blocks LB 1 to LBn may be different from at least one conversion ratio from among the plurality of the light-emitting blocks LB1 to LBn.

Referring to FIGS. 6 and 7*b*, the data converter 625 converts the red image signal, the green image signal and the blue image signal using the conversion ratios TR1 to TRn, which are determined by the conversion ratio determining unit 623, and outputs a converted image signal IDAT. In further detail, as shown in FIG. 7*b*, the data converter 625 converts the second grayscale, which in this embodiment is the reference grayscale from the green image signal (Gg0 in FIG. 7*a*) i.e., the reference image signal, so that the green image signal corresponds to the maximum grayscale Gmax. As described above, the conversion ratio for converting the green image signal is determined as a ratio of the second grayscale Gg0 to the maximum grayscale.

The conversion ratio, determined using the reference image signal, is applied to the remaining image signals. Thus in an embodiment the conversion ratio T0, determined using the data frequency Fg0 of the green image signal, which is the reference image signal, is used to convert the remaining image signals, which in an embodiment are the red image signal and the blue image signal. Accordingly, the red image signal, the green image signal and the blue image signal may be converted through application of the same conversion ratio. As shown in FIG. 7*b*, since the conversion ratio of the reference image signal is a value obtained by making the reference grayscale correspond to the maximum grayscale, the second grayscale of the green image signal, which is the reference image signal, corresponds to the maximum grayscale by application of the conversion ratio. However, the remaining image signals, which in an embodiment are the first grayscale of the red image signal and the third grayscale of the blue image signal, may not correspond to the maximum grayscale since the same conversion ratio is applied thereto.

The data converter 625 may use a data stretching method to convert each image signal.

Referring again to FIG. 5, the representative value determining unit 630 may determine a representative image signal R_DB1 to R_DBn corresponding to each display block DB1 to DBn. Thus, in an embodiment the representative value determining unit 630 may receive the input of the data frequencies F1 to Fn of the red image signal, the green image signal and the blue image signal, and determine the representative image signals R_DB1 to R_DBn. Each representative image signal R_DB1 to R_DBn may refer to an average luminance of each representative image block DB1 to DBn. Further, each representative image signal R_DB1 to R_DBn may refer to a grayscale of each representative image block DB1 to DBn.

The light data signal controller 600_2 of FIG. 1 is hereinafter further described in detail with reference to FIG. 8. The light data signal controller 600_2 includes a luminance converter 640 and a light data signal output unit 650.

The luminance converter 640 first receives input of the plurality of the representative image signals R_DB1 to R_DBn, determines a luminance R_LB1 to R_LBn of each light-emitting block LB1 to LBn corresponding to each representative image signal R_DB1 to R_DBn and outputs the luminance R_LB1 to R_LBn of each light-emitting block LB1 to LBn to the light data signal output unit 650. The luminance converter 640 determines the luminance R_LB1 to R_LBn of each light-emitting block LB1 to LBn corresponding to each representative image signal R_DB1 to R_DBn using a look-up table (not shown). Determination of the luminance is further described with reference to FIG. 9.

The light data signal output unit 650 outputs a light data signal LDAT to be applied to each light-emitting block LB1 to LBn. The light data signal LDAT may control the luminance of light supplied by the light-emitting unit.

A process for determining a duty ratio of the light data signal LDAT, which can be applied to each light-emitting block LB1 to LBn, is described with reference to FIG. 9.

In FIG. 9 the abscissa indicates a grayscale of the image signals and the ordinate indicates luminance. A gamma curve (A) has a selected gamma value for gamma correction. In an embodiment, the gamma value may be 2.2.

First, a point P1 corresponding to the reference grayscale Gref is found using the gamma curve (A) to thereby determine a first luminance a, and the first luminance a is applied to the maximum grayscale Gmax to determine the duty ratio of the light data signal LDAT. In a liquid crystal display including a plurality of the light-emitting blocks LB1 to LBn, the duty ratio of the light data signal LDAT of each of the light-emitting blocks LB1 to LBn may be independently determined through the process described above.

As shown in FIG. 9, when the reference grayscale Gref is applied to the maximum grayscale Gmax at point P1 corresponding to the gamma curve (A), a duty curve (B) having the same luminance a may be obtained. The second luminance b of point P2 corresponding to the duty curve (B) may be lower than the first luminance a. Accordingly, since the light data signal LDAT has a second duty ratio corresponding to the second luminance, which is lower than the first duty ratio corresponding to the first luminance a, the amount of power required when the light-emitting unit supplies light to the display panel may be reduced.

In an embodiment, the light data signal has the second duty ratio, which is less than the first duty ratio, which corresponds to the reference grayscale of the reference image signal, and the luminance, when selected by application of the second duty ratio to the maximum grayscale Gmax, and the luminance, when selected by application of the first duty ratio to the reference grayscale Gref, may be the same. Accordingly, the duty ratio of the light data signal LDAT may be reduced to thereby reduce power consumption while maintaining the same brightness.

Referring to FIG. 10, grayscale data frequencies of the red image signal, the green image signal and the blue image signal before conversion are the same respectively as the grayscale data frequencies of the red image signal, the green image signal and the blue image signal after conversion.

The data frequency of each image signal before conversion is shown at the left of the drawing and is labeled "before," and the data frequency of each image signal after conversion is shown at the right of the drawing labeled "after." The label "IMAGE" indicates the image to be displayed on the display panel. An image may be divided into a plurality of regions, for example, first through seventh regions REGION1 to REGION7, which may correspond to a plurality of display blocks.

A grayscale data frequency is extracted for each region, such as REGION1 to REGION7, a reference grayscale Gref1 to Gref7, a reference image signal Iref1 to Iref7 and a conversion ratio TR1 to TRn are determined for each region using the reference grayscales Gref1 to Gref7 and a maximum grayscale Gmax. A duty ratio D1 to D7 of each light-emitting block LB1 to LBn, which correspond to the respective display regions REGION1 to REGION7, is determined using the reference grayscales Gref1 to Gref7. The horizontal bar graphs at the center of the drawing show the duty ratios D1 to D7 of each of the display regions REGION1 to REGION7, and the portions marked with the slanted lines in the bar graphs indicate duty ratios of the respective regions.

A converted image signal, which is converted by applying a conversion ratio of an image signal for each region, which is determined using the grayscale data frequency, may be extracted for each region, such as REGION1 to REGION7. For example, a duty ratio D1 to D7, determined for each corresponding region REGION1 to REGION7, may be applied to data, which has been stretched through data stretching to obtain a converted image signal. By extracting the grayscale data frequency with respect to each region of the converted image signal in this manner, results may be obtained which are identical to grayscale data frequencies of the respective regions prior to conversion.

In an embodiment, the red image corresponding to the red image signal and has a wavelength with a main peak between about 600 nanometers ("nm") to about 650 nm, specifically about 620 nm to about 630 nm and a half amplitude between about 5 nm to about 30 nm, specifically about 15 nm or less; the green image corresponding to the green image signal has a wavelength with a main peak between about 500 nm to about 550 nm, specifically about 525 nm to about 535 nm and a half amplitude between about 15 nm to about 60 nm, specifically about 30 nm or less; and the blue image corresponding to the blue image signal has a wavelength with a main peak between about 425 to about 480 nm, specifically about 445 nm to about 455 nm and a half amplitude between about 10 nm to about 30 nm, specifically about 19 nm or less. However, this is merely an example of the ranges associated with the images, and the disclosed embodiment is not limited in this regard.

Furthermore, the plurality of line graphs overlapping the bar graphs indicates luminance distribution of the display panel. In particular, curves 11 to 17 indicate the luminance distributions for each light-emitting block corresponding to the first through seventh regions. For example, 11 indicates the luminance distribution displayed on the display panel when light is supplied through the first duty ratio D1 to D7 independently to the light-emitting block corresponding to the first region. The dark solid line Ltot indicates a combined luminance distribution when the individual luminance distributions for the first through seventh regions are combined. Since the luminance for each region may be influenced by the luminance of the surrounding regions, when the duty ratio of each region is determined, the combined luminance distribution Ltot may be taken into consideration.

According to the disclosed embodiments, the grayscale data frequency of each of the red image signal, the green image signal and the blue image signal can be extracted, and using one of these as a reference, the remaining image signals are converted, such that data distortion caused by excessive compensation of data may be reduced or effectively prevented and display quality enhanced. Further, using a small duty ratio, an image, having a luminance, is obtained, which would require a larger duty ratio using conventional techniques, thereby reducing power consumption.

While embodiments of the invention have been shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display comprising:

a display panel, which displays an image corresponding to a primary image signal, which includes a first image signal, a second image signal and a third image signal;

a light-emitting unit, which supplies light to the display panel; and a timing controller, which receives an input comprising the primary image signal, and outputs a converted image signal, wherein the timing controller converts each of the first image signal, the second image signal and the third image signal on a basis of whichever one of the first image signal, the second image signal and the third image signal is selected, and outputs the converted image signal, and wherein the light-emitting unit determines a luminance of the light supplied to the display panel according to a reference grayscale of a reference image signal, the reference image signal being selected based on a maximum grayscale among the first image signal, the second image signal and the third image signal, wherein the first image signal is a red image signal, the second image signal is a green image signal and the third image signal is a blue image signal, wherein the timing controller supplies a light data signal which controls the luminance of the light, the light data signal having a first duty ratio, the first duty ratio being less than a second duty ratio and corresponding to the reference grayscale of the reference image signal, and wherein the luminance, when selected by application of the first duty ratio to the maximum grayscale, is substantially the same as a reference luminance selected by application of the second duty ratio to the reference grayscale.

2. The liquid crystal display of claim 1, wherein the selected one of the first image signal, the second image signal and the third image signal has the largest grayscale, and the reference image signal is an image signal of the first image signal, the second image signal and the third image signal having the largest grayscale.

3. The liquid crystal display of claim 1, wherein the timing controller extracts a grayscale data frequency of each of the first image signal, the second image signal and the third image signal;

designates largest grayscales in each of the first, second and third image signals respectively as a first grayscale, a second grayscale and a third grayscale; and designates a largest grayscale among the first, second and third grayscales as the reference grayscale, and selects the image signal having the reference grayscale to be the reference image signal.

4. The liquid crystal display of claim 1, wherein the largest grayscale, which can be displayed for each of the first image signal, the second image signal and the third image signal is a maximum grayscale, and the timing controller extracts the grayscale data frequency of each of the first image signal, the second image signal and the third image signal, and determines a conversion ratio as a ratio of the reference grayscale with respect to the maximum grayscale, and wherein the timing controller applies the conversion ratio to convert the first image signal, the second image signal and the third image signal.

5. The liquid crystal display of claim 1, wherein the grayscale data frequencies of the first image signal, the second image signal and the third image signal before conversion are the same respectively as the grayscale data frequencies after conversion of the first image signal, the second image signal and the third image signal.

6. The liquid crystal display of claim 1, wherein:

the display panel comprises a plurality of display blocks;

the light-emitting unit comprises a plurality of light-emitting blocks corresponding to the plurality of the display blocks; and the timing controller converts the first image signal, the second image signal and the third image signal for each of the light-emitting blocks.

7. The liquid crystal display of claim 6, wherein the largest grayscale of the first image signal, the second image signal and the third image signal is a maximum grayscale, and the timing controller extracts the grayscale data frequency of each of the first image signal, the second image signal and the third image signal for each light-emitting block and determines a conversion ratio the first image signal, the second image signal and the third image signal as a ratio of the maximum grayscale with respect to the reference grayscale, and wherein the timing controller applies the conversion ratio to each of the light-emitting blocks to convert the first image signal, the second image signal and the third image signal of each of the light-emitting blocks.

8. The liquid crystal display of claim 7, wherein each of the conversion ratios of the plurality of the light-emitting blocks is different from at least one of the conversion ratios.

9. The liquid crystal display of claim 1, wherein the timing controller uses a data stretching method to convert each of the first image signal, the second image signal and the third image signal.

10. The liquid crystal display of claim 1, wherein when the first image signal is a red image signal, the second image signal is a green image signal and the third image signal is a blue image signal, a red image corresponding to the red image signal has a wavelength with a main peak between about 620 nanometers to about 630 nanometers and a half amplitude of about 15nanometers or less;

a green image corresponding to the green image signal has a wavelength with a main peak between about 525 nanometers to about 535 nanometers and a half amplitude of about 30 nanometers or less; and a blue image corresponding to the blue image signal has a wavelength with a main peak between about 445 nanometers to about 455 nanometers and a half amplitude of about 19 nanometers or less.

11. A method of driving a liquid crystal display, the method comprising:

providing a display panel, which displays an image corresponding to a primary image signal, which includes a first image signal, a second image signal and a third image signal;

receiving the primary image signal;

converting each of the first image signal, the second image signal and the third image signal on a basis of whichever one of the first image signal, the second image signal and the third image signal is selected, and outputting the converted image signal; and determining a luminance of the light supplied to the display panel according to a reference grayscale of a reference image signal, the reference image signal being selected based on a maximum grayscale among the first image signal, the second image signal and the third image signal, wherein the first image signal is a red image signal, the second image signal is a green image signal and the third image signal is a blue image signal, wherein the determining of the luminance of the light comprises generating a light data signal corresponding to the luminance of the light, the light data signal having a first duty ratio, the first duty ratio being less than a second duty ratio and corresponding to the reference grayscale of the reference image signal, and wherein the luminance, when selected by application the first duty ratio to the maximum grayscale is substantially the same as a reference luminance selected by application the second duty ratio to the reference grayscale.

12. The method of claim 11, wherein the selected one of the first image signal, the second image signal and the third image signal has the largest grayscale, and the reference image signal is an image signal of the first image signal, the second image signal and the third image signal having the largest grayscale.

13. The method of claim 11, wherein the converting of each of the first image signal, the second image signal and the third image signal further comprises:

extracting a grayscale data frequency of each of the first image signal, the second image signal and the third image signal;

designating largest grayscales in each of the first, second and third image signals respectively as a first grayscale, a second grayscale and a third grayscale; and designating a largest grayscale among the first, second and third grayscales as the reference grayscale, and selecting the image signal having the reference grayscale to be the reference image signal.

14. The method of claim 11, wherein the largest grayscale of each of the first image signal, the second image signal and the third image signal is a maximum grayscale, and the converting of each of the first image signal, the second image signal and the third image signal comprises extracting the grayscale data frequency of each image signal and determining a conversion ratio as the maximum grayscale with respect to the standard grayscale.

15. The method of claim 11, wherein the grayscale data frequencies of the first image signal, the second image signal and the third image signal before conversion are the same respectively as the grayscale data frequencies after conversion of the first image signal, the second image signal and the third image signal.

16. The method of claim 11, wherein:

the display panel further comprises a plurality of display blocks disposed in a matrix configuration;

a plurality of light-emitting blocks supplying light to the display blocks, the display blocks comprising rows of the matrix; and the first image signal, the second image signal and the third image signal are converted for each of the light-emitting blocks.

17. The method of claim 16, wherein the largest grayscale, which can be displayed for each of the first image signal, the second image signal and the third image signal is a maximum grayscale, the conversion of the first image signal, the second image signal and the third image signal for each of the light-emitting blocks comprises extracting the grayscale data frequency of each of the first image signal, the second image signal and the third image signal for each light-emitting block, and determining a conversion ratio as a ratio of the reference grayscale with respect to the maximum grayscale for each of the light- emitting blocks, the conversion ratio being applied to each of the light-emitting blocks to convert the first image signal, the second image signal and the third image signal of each of the light-emitting blocks.

18. The method of claim 17, wherein the application of the conversion ratio to each of the light-emitting blocks comprises applying the conversion ratio, which is different from at least one of the conversion ratios from among the plurality of the light- emitting blocks.

19. The method of claim 11, wherein when the first image signal is a red image signal, the second image signal is a green image signal and the third image signal is a blue image signal, a red image corresponding to the red image signal has a wavelength with a main peak between about 620 nanometers to about 630 nanometers and a half amplitude of about 15nanometers or less;

a green image corresponding to the green image signal has a wavelength with a main peak between about 525 nanometers to about 535 nanometers and a half amplitude of about 30 nanometers or less; and a blue image corresponding to the blue image signal has a wavelength with a main peak between about 445 nanometers to about 455 nanometers and a half amplitude of about 19 nanometers or less.

* * * * *